US005539439A

United States Patent [19]

Ono et al.

[11] Patent Number: 5,539,439

[45] Date of Patent: Jul. 23, 1996

[54] THERMAL TRANSFER RECORDING APPARATUS IN WHICH THE RECORDING MEDIUM AND INK SHEET CAN BE RESTRAINED

[75] Inventors: Takeshi Ono, Yokohama; Takehiro Yoshida, Tokyo; Makoto Kobayashi, Tama; Satoshi Wada, Kawasaki; Hisao Terajima, Yokohama; Minoru Yokoyama, Yokohama; Takashi Awai, Yokohama; Akihiro Tomoda, Yokohama; Yasushi Ishida, Tokyo, all of Japan

[73] Assignee: Canon Kabushiki Kaisha, Tokyo, Japan

[21] Appl. No.: 407,246

[22] Filed: Mar. 20, 1995

Related U.S. Application Data

[63] Continuation of Ser. No. 296,979, Aug. 26, 1994, abandoned, which is a continuation of Ser. No. 65,050, May 24, 1993, abandoned, which is a continuation of Ser. No. 422,668, Oct. 17, 1989, abandoned.

[30] Foreign Application Priority Data

Oct. 20, 1988 [JP] Japan ..... 63-262828

[51] Int. Cl.[6] ..... B41J 2/325

[52] U.S. Cl. ..... 347/76

[58] Field of Search ..... 347/215, 217, 347/218, 219; 400/231, 224.2, 618

[56] References Cited

U.S. PATENT DOCUMENTS

| | | | |
|---|---|---|---|
| 4,456,392 | 6/1984 | Nozaki et al. | 400/120 |
| 4,468,676 | 8/1984 | Nakajima et al. | 346/76 PH |
| 4,661,826 | 4/1987 | Saitou | 346/76 PH |
| 4,709,149 | 11/1987 | Takahashi | 250/317.1 |
| 4,814,789 | 3/1989 | Ono | 346/76 PH |
| 4,885,755 | 12/1989 | Yoshida | 375/8 |

FOREIGN PATENT DOCUMENTS

| | | | |
|---|---|---|---|
| 2508259 | 12/1982 | France . | |
| 3317060 | 11/1983 | Germany . | |
| 120454 | 7/1982 | Japan | 346/76 PH |
| 59-70595 | 4/1984 | Japan . | |
| 2095177 | 6/1984 | Japan . | |
| 192587 | 10/1984 | Japan | 346/76 PH |
| 0245567 | 12/1985 | Japan | 400/231 |
| 62-196158 | 8/1987 | Japan . | |

OTHER PUBLICATIONS

Eur. Pat. Off. Search Report for Eur. Pat. App. No. 89119426.8.

*Primary Examiner*—N. Le

*Attorney, Agent, or Firm*—Fitzpatrick, Cella, Harper & Scinto

[57] ABSTRACT

There is disclosed a thermal transfer recording apparatus for recording an image by ink transfer from an ink sheet to a recording sheet, capable, in conveyance of either sheet only, of preventing the other sheet, from being drawn therewith by increasing the holding force for retaining the other sheet in the stopped state at conveyance of the first-mentioned sheet.

18 Claims, 6 Drawing Sheets

THERMAL TRANSFER RECORDING APPARATUS IN WHICH THE RECORDING MEDIUM AND INK SHEET CAN BE RESTRAINED

This application is a continuation, of application Ser. No. 08/296,979 filed Aug. 26, 1994 abandoned, which is a continuation of application Ser. No. 08/065,050 filed May 24, 1993 abandoned, which is a continuation of application Ser. No. 07/422,668 filed Oct. 17, 1989 abandoned.

BACKGROUND OF THE INVENTION

1. Field of the Invention

The present invention relates to a thermal transfer recording apparatus and a facsimile apparatus for transferring ink from an ink sheet to a recording medium thereby recording an image thereon.

The above-mentioned thermal transfer recording apparatus can be employed in to the facsimile apparatus mentioned above, as well as an electronic typewriter, a copying apparatus, a printer or the like.

2. Related Background Art

In the following description, a thermal transfer printer will be explained as an example of the recording apparatus.

In a thermal transfer printer, image recording is generally achieved by employing an ink sheet consisting of heat fusible ink (or heat sublimable ink) coated on a base film, and selectively heating the ink sheet with a thermal head according to image signals, thereby transferring fused (or sublimed ink) onto a recording sheet. In such a thermal transfer printer, the ink sheet and the recording sheet are in kept mutual contact in the vicinity of a recording position by said thermal head, with an increased adhesive force particularly in areas heated by the thermal head.

Consequently, the ink sheet may be conveyed together with the recording sheet when it is necessary to advance the recording sheet only while it is desirable to stop the ink sheet, for example in the recording of a line of white image data, or in case of skipping a white area (area of no image recording). Such transportation of ink sheet can be prevented to a certain extent in an apparatus equipped with a mechanism for separating the thermal head from the platen to thereby eliminate the contact between the recording sheet and the ink sheet in case of transportation of the recording sheet alone. However, in a printer lacking this mechanism for separating the thermal head from the platen, such as a full-line thermal transfer printer, the ink sheet may be transported together with the recording sheet.

Also since the ink sheet adheres to the recording sheet because of ink transfer to the recording sheet by the heating of the ink sheet, the adhesion of the ink sheet and the recording sheet is not avoided by elimination of the pressure thereon, so that the combined movement of the two cannot be avoided.

SUMMARY OF THE INVENTION

An object of the present invention is to provide a thermal transfer recording apparatus, and a facsimile apparatus, capable of providing sharp recorded images.

Another object of the present invention is to provide an thermal transfer recording apparatus and a facsimile apparatus capable of satisfactorily transporting the recording medium, while stopping movement of the ink sheet.

Still another object of the present invention is to provide a thermal transfer recording apparatus, and a facsimile apparatus capable of securely maintaining in the stopped state when the ink sheet so desired.

Still another object of the present invention is to provide a thermal transfer recording apparatus, and a facsimile apparatus, capable of securely transporting and stopping movement of the ink sheet and the recording medium.

Still another object of the present invention is to provide a thermal transfer recording apparatus, and a facsimile apparatus, capable, when transporting the recording medium or the ink sheet, of increasing the force for preventing the ink sheet or the recording medium from being moved, thereby preventing the combined motion of the recording medium and the ink sheet.

Still another object of the present invention is to provide a thermal transfer recording apparatus, and a facsimile apparatus, capable, when transportation of the recording medium or the ink sheet, of increasing the preventing movement of force for retaining the other.

DETAILED DESCRIPTION OF THE PREFERRED EMBODIMENTS

Now the present invention will be clarified in detail by preferred embodiments thereof shown in the attached drawings.

[Explanation of facsimile apparatus (FIGS. 1 to 4)]

Figure 1:
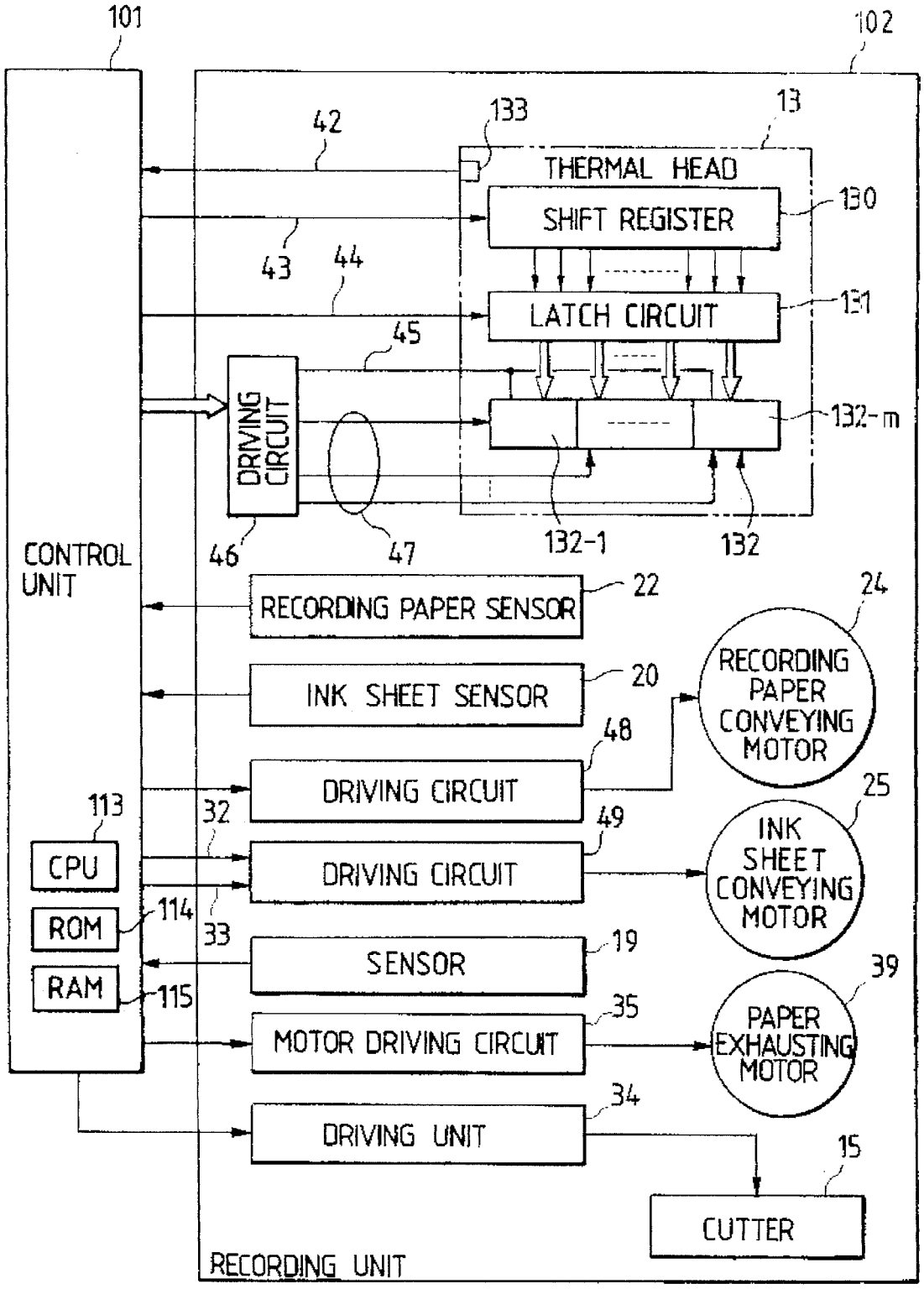
FIG. 1 is a block diagram showing electrical connections between a control unit and a recording unit of an embodiment of the present invention.
Figure 2:
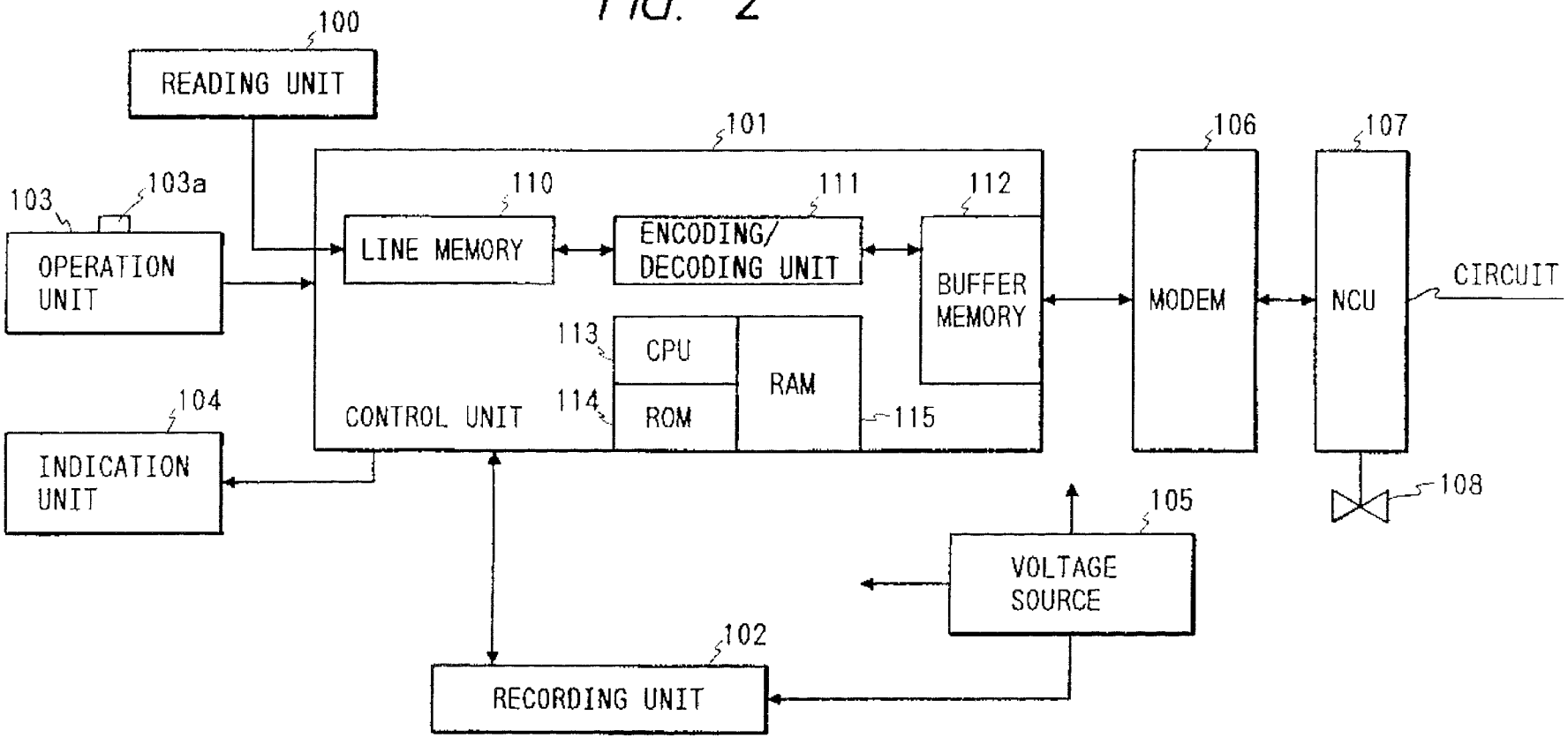
FIG. 2 is a block diagram of a facsimile apparatus embodying the present invention.
Figure 3A:
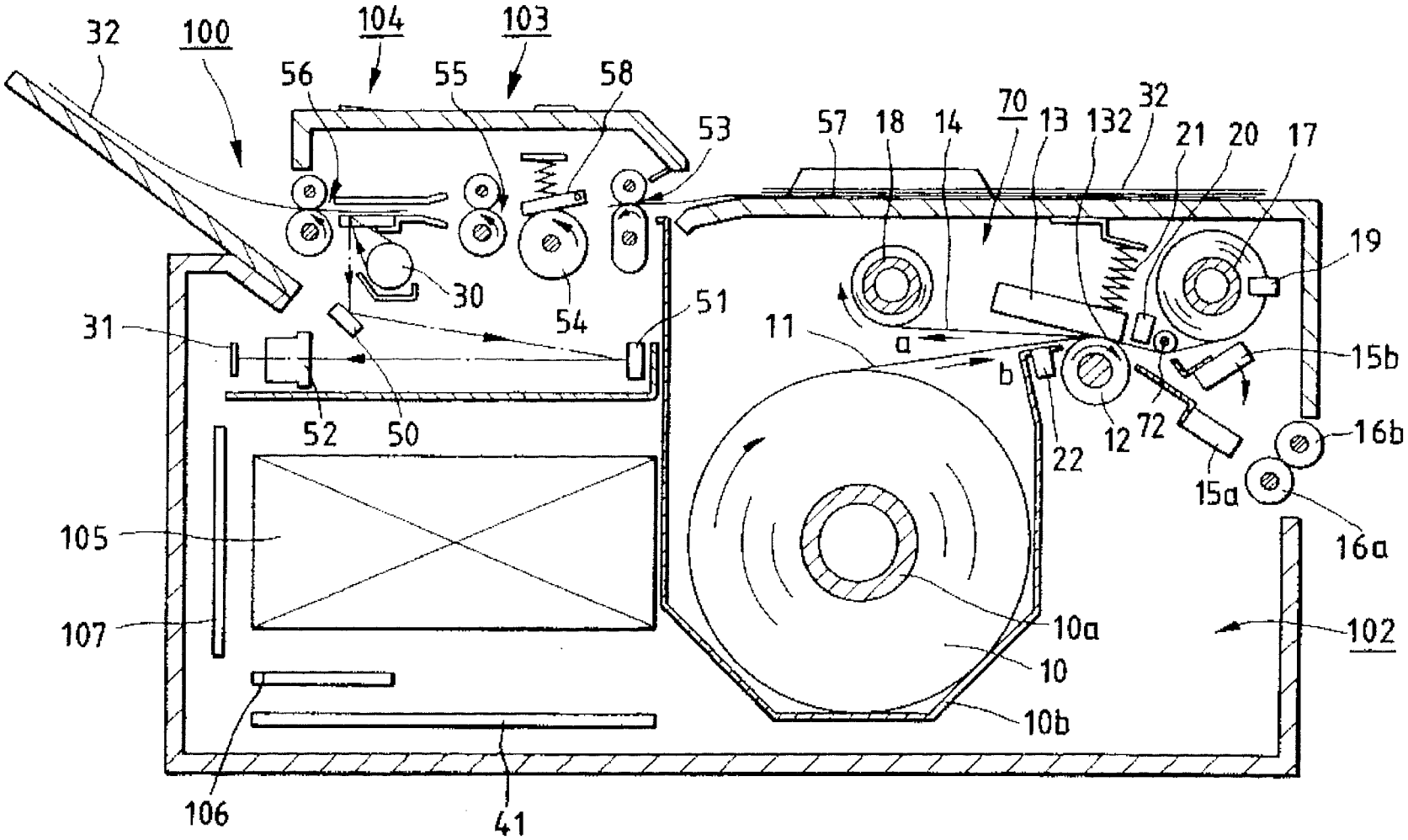
FIG. 3A is a lateral cross-sectional view of the structure of a facsimile apparatus embodying the present invention.
Figure 3B:
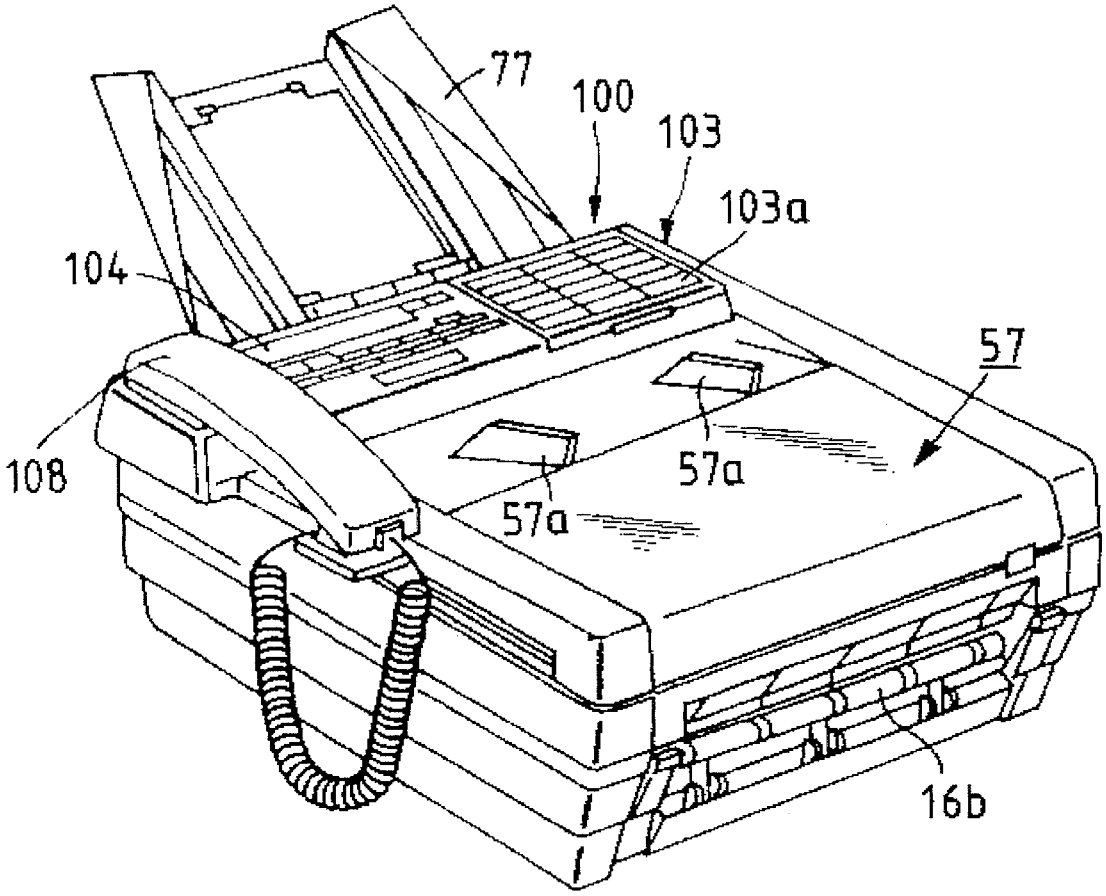
FIG. 3B is an external perspective view of the facsimile apparatus shown in FIG. 3A.
Figure 4:
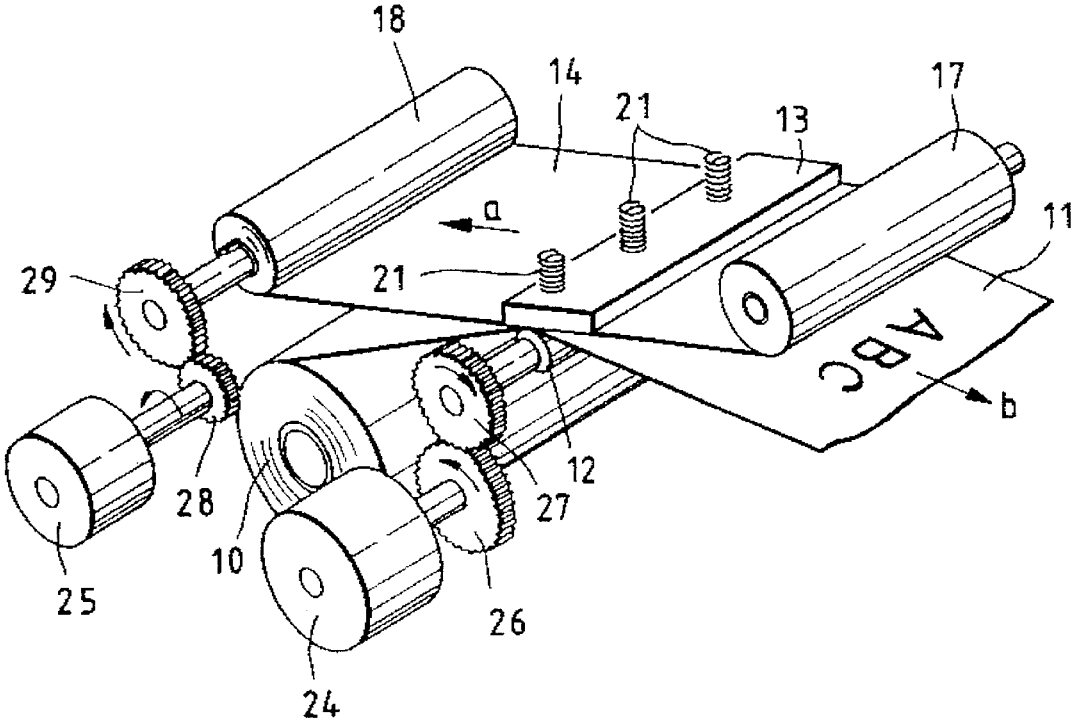
FIG. 4 is a schematic view of a transporting system for the ink sheet and the recording sheet.

FIGS. 1 to 4 illustrate a thermal transfer printer embodying the present invention, applied to a facsimile apparatus, wherein FIG. 1 is a block diagram showing the electrical connection of a control unit 101 and a recording unit 102 of the facsimile apparatus, FIG. 2 is a block diagram of the facsimile apparatus, FIG. 3A is a lateral cross-sectional view of the facsimile apparatus, FIG. 3B is an external perspective view thereof, and FIG. 4 is a schematic view of a transporting mechanism for the recording sheet and the ink sheet.

At first reference is made to FIG. 2 for explaining the outline of the structure of the facsimile apparatus.

A reading unit 100, for photoelectrically reading an original image and sending digital image signals to a control unit 101, is provided with an original transporting motor and a CCD image sensor. The control unit 101 is constructed in the following manner. A line memory 110 for storing image data of each line, serves to store image data of one line from the reading unit 100 in case of transmission or copying of the original image, or decoded image data of one line in case of reception of image data. The image formation is conducted by the transfer of thus stored data to a recording unit 102. An encoding/decoding unit 111 encodes the image information to be transmitted, for example by MH encoding, and decodes the received image codes into image data. A buffer memory 112 serves to store encoded image data which are to be transmitted or are received. These units of the control unit 101 are controlled by a CPU 113 composed for example of a microprocessor. The control unit 101 is further provided with a ROM 114 storing the control program of the CPU 113 and various data, and a RAM 115 for temporarily storing various data, as a work area for the CPU 113.

A recording unit 102 is provided with a thermal line head for image recording on a recording sheet by the thermal transfer recording method. The structure of this unit will be explained later in detail, with reference to FIG. 3. There are further provided an operation unit 103 equipped with function keys such as a transmission start key, and input keys for telephone numbers; a display unit 104 positioned next to the operation unit 103 and serving to indicate the status of the apparatus and the various functions; a power supply unit 105 (voltage source) for supplying the entire apparatus with electric power; a modem 106 (modulator/demodulator); a network control unit (NCU); and a telephone unit 108.

In the following there will be given a detailed explanation of the structure of the recording unit 102 with reference to FIGS. 3A and 3B, in which the components as those in FIG. 2 are represented by the numbers.

A roll 10 of recording material 11, composed of plain paper and wound on a core 10*a*, is rotatably housed in the apparatus so as to supply a thermal head 13 with the recording sheet 11 by the rotation of a platen roller 12 in a direction indicated by an arrow. A rolled sheet container 10*b* detachably holds the rolled sheet 10. The platen roller 12 serves to transport the recording sheet 11 in a direction b, and to press the ink sheet 14 and the recording sheet 11 in cooperation with heat-generating members 132 of the thermal head 13. After being undergoing image recording by the heat generated by the thermal head 13, the recording sheet 11 is advanced toward discharge rollers 16*a*, 16*b* by further rotation of the platen roller 12, and is cut into a page by the engagement of cutters 15*a*, 15*b* and discharged after the image recording of a page.

An ink sheet feed roll 17 is composed of wound ink sheet 14. An ink sheet take-up roll 18 is driven by an ink sheet transport motor for winding the ink sheet 14 in a direction a. The feed roll 17 and take-up roll 18 are detachably loaded in an ink sheet loader 70 in the apparatus. A sensor 19 is provided for detecting the remaining amount and the transport speed of the ink sheet 14. An ink sheet sensor 20 is provided for detecting the presence of the ink sheet 14. A spring 21 is provided for pressing the thermal head 13 against the platen roller 12 across the recording sheet 11 and the ink sheet 14. A recording sheet sensor 22 detects the presence of the recording sheet.

In the following there will be explained the structure of the reading unit 100.

A light source 30 is provided for illuminating the original document 32. The light reflected thereby enters a CCD sensor 331 through an optical system (mirrors 50, 51 and a lens 52), and is converted into electrical signals. The original document 32 is transported, corresponding to the reading speed therefor, by transport rollers 53, 54, 55, 56 driven by an unrepresented original transport motor. Plural original documents 32 stacked on an original stacker 57 are guided by a slider 57*a* and separated one by one through the cooperation of the transport roller 54 and a separating member 58. The original document is thus transported to the reading unit 100, and, after the image reading, discharged to a tray 77.

There are provided a control board constituting the principal part of the control unit 101 and sending various control signals to the various units of the apparatus, a modem board 106, and an NCU board 107.

FIG. 4 shows the details of the transporting mechanism for the ink sheet 14 and the recording sheet 11.

A recording sheet transporting motor 24 rotates the platen roller 12, thereby advancing the recording sheet 11 in a direction b, which is opposite to the direction a. An ink sheet transporting motor 25 advances the ink sheet 14 in the direction a, namely the direction of successive image recording along the longitudinal direction of the recording sheet 11. There are also provided gears 26, 27 for transmitting the rotation of the recording sheet transporting motor 24 to the platen roller 12, and gears 28, 29 for transmitting the rotation of the ink sheet transporting motor 25 to the take-up roll 18.

As explained in the foregoing, the recording sheet 11 and the ink sheet 14 are transported or conveyed in mutually opposite directions, and are brought into mutual contact in an area positioned between the thermal head 13 and the platen roller 12. The thermal head 13 is constantly biased toward the platen roller 12 by the spring 21. Therefore, when the recording sheet 11 is advanced in the direction b, the ink sheet 14 tends to be drawn in the same direction. If the energizing or exciting current for the ink sheet transporting motor 25 is turned off, the ink sheet 14 is drawn in the direction opposite to the direction a, thus generating creases or slack since the motor 25 can freely rotate. In the present embodiment, therefore, the holding torque of the ink sheet transporting motor 25 is increased at the transportation of the recording sheet 11 as will be explained later, thereby preventing the ink sheet 14 being drawn in the direction b by the movement of the recording sheet 11.

FIG. 1 shows the electrical connection between the control unit 101 and the recording unit 102 in the facsimile apparatus of the present embodiment, wherein the same components as those in other drawings are represented the same numbers.

A thermal head 13, which is constructed as a line head, is provided with a shift register 130 for storing serial recording data of a line and shift clock signals 43 from the control unit 101, a latch circuit 131 for latching the data of the shift register 130 in response to a latch signal 44, and plural heat-generating elements 132 consisting of heat-generating resistors 132 are driven in divided manner in m blocks represented by 132-*l*–132-*m*. A temperature sensor 133, mounted on the thermal head 13 for detecting the temperature thereof, generates an output signal 42, which is A/D converted in the control unit 101 and supplied to the CPU 113. Thus detecting the temperature of the thermal head 13, the CPU 113 regulates the energy supplied to the thermal head 13 for example by varying the pulse duration of a strobe signal 47 or the driving voltage for the thermal head 13, according to the temperature and characteristics or type of the ink sheet 14.

The species (characteristics) of the ink sheet 14 may be automatically identified by switch on the operation unit 103 (not shown) or by detecting a mark printed on the ink sheet 14. Also it may be automatically identified by detecting a mark, a notch or a protruding part provided on a cartridge of the ink sheet.

A driving circuit 46 receives a drive signal for the thermal head 13 from the control unit 101 and releases a strobe signal 47 for driving each block of the thermal head 13. The driving circuit 46 can vary the energy supplied to the thermal head 13 by varying the voltage supplied to a power supply line 45 supplying electric power to the heat-generating elements 132 of the thermal head 13, in response to an instruction of the control unit 101. A driving unit 34 for causing the engagement of the cutter elements 15 contains a cutter driving motor. There are also provided a discharge motor 39 for driving the sheet discharge rollers 16, and motor driving circuits 35, 48, 49 respectively for the discharge motor 39, recording sheet transporting motor 24 and ink sheet transporting motor 25.

There are also shown a current control signal 32 released from the control unit 101 for controlling the energizing current of the motor driving circuit 49, and an energizing signal 33 for controlling the energization of the motor driving circuit 49. The above-mentioned motors 39, 24, 25 are composed of stepping motors in the present embodiment, but they may also be composed, for example, of DC motors.

[Recording operation ( FIGS. 1 to 5 )]

Figure 5:
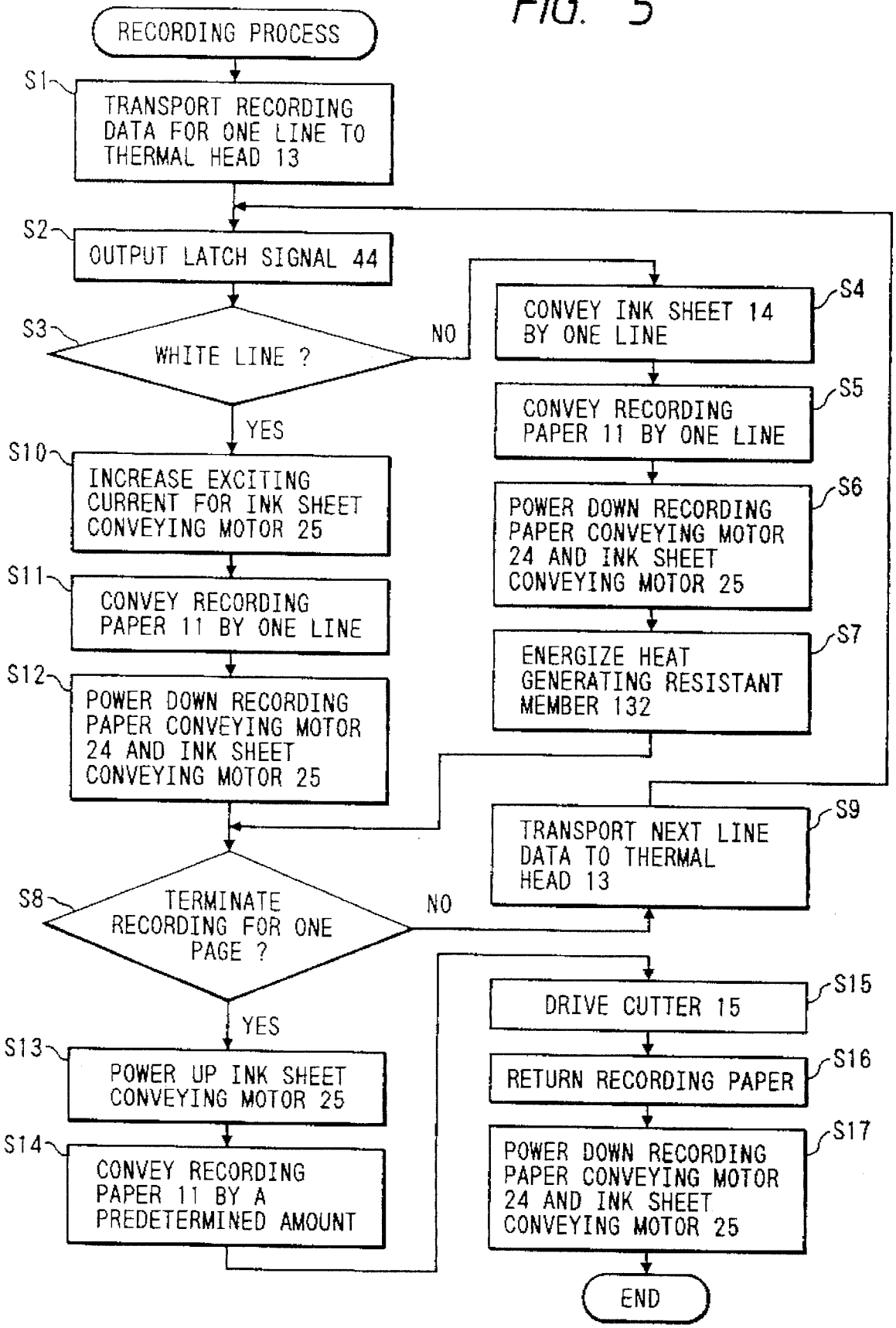
FIG. 5 is a flow chart of the recording sequence of this embodiment.

FIG. 5 is a flow chart of the recording sequence of a page in the facsimile apparatus of the present embodiment. A corresponding control program is stored in ROM 114 of the control unit 101.

The sequence is started when the apparatus becomes ready for the recording operation by storing the image data of a line to be recorded in the line memory 110. At first a step S1 sends the recording data of a line in serial manner to the shift register 130. After the transfer of the recording data of a line, a step S2 releases the latch signal 44, thereby storing the recording data of a line in the latch circuit 131. Then a step S3 discriminates whether the recording data of one line are all white (absence of data).

If the data are not all white, a step S4 activates the ink sheet transporting motor 25 to advance the ink sheet 14 by one line in the direction a shown in FIG. 4. Then a step S5 activates the recording sheet transporting motor 24 to advance the recording sheet 11 in the direction b by one line. One line corresponds to the length of a dot recorded by the thermal head 13. Then a step S6 deactivates the recording sheet transporting motor 24 and the ink sheet transporting motor 25, and a step S7 energizes each block of the heat-generating resistors 132, thereby effecting image recording. After the image recording of a line in this manner, a step S8 discriminates whether the recording of a page has been completed. If not completed, a step S9 transfers the recording data of a next line to the thermal head 13, and the sequence returns to the step S2.

On the other hand, if the step S3 indentifies that the recording data of one line are all white data, the sequence proceeds to a step S10 for increasing the energizing current for the ink sheet transporting motor 25 by the current control signal 32, thereby elevating the holding torque of motor 25. Then a step S11 drives the recording sheet transporting motor 24 by a predetermined number of pulses, thereby advancing the recording sheet 11 by a line. Thus the ink sheet 14 is not dragged by the movement of the recording sheet 11. Then a step S 12 deactivates the recording sheet transporting motor 24 and the ink sheet transporting motor 25, and the sequence proceeds to the step S8.

When the step S8 identifies the completion of recording of a page, the sequence proceeds to a step S10 for increasing the energizing current for the ink sheet transporting motor 25 to elevate the holding torque thereof as in the step S10. Then a step S14 advances the recording sheet 11 by a predetermined amount toward the discharge rollers 16*a*, 16*b*. A next step S15 activates the cutter elements 15*a*, 15*b* to cut the recording sheet 11 into a page. A next step S16 reverses the recording sheet transporting motor 24 to move the recording sheet backwards by an amount corresponding to the distance between the thermal head 13 and the cutter 15. Then a step S 17 deactivates the ink sheet transporting motor 25 and the recording sheet transporting motor 24, thereby completing the sequence of image recording of a page.

As indicated in the steps S4 and S5 explained above, the ink sheet transporting motor 25 is preferably activated prior to the recording sheet transporting motor 24, because the actual start of movement of the ink sheet 14 is delayed in time from the activation of the ink sheet transporting motor 25 due to the characteristics of the motor and the transmission system therefor. Though a similar effect can be obtained even when the recording sheet transporting motor 24 is activated first, the recorded dots may become spaced if the time from the start of transportation of the recording sheet 11 to the activation of the thermal head 13 (recording operation in the step S7) becomes too long.

As explained in the foregoing, the dragging of the ink sheet 14 by the movement of the recording sheet can be prevented by increasing the energizing power for the ink sheet transporting motor 25 at the transportation of the recording sheet 11.

In the present embodiment there has been explained a case of transporting the recording sheet 11 only while the ink sheet 14 is stopped, but, in case of advancing the ink sheet 14 only while the recording sheet 11 is stopped, dragging of the recording sheet 11 by the ink sheet 14 can be prevented by increasing the energizing current for the recording sheet transporting motor 24.

Figure 6:
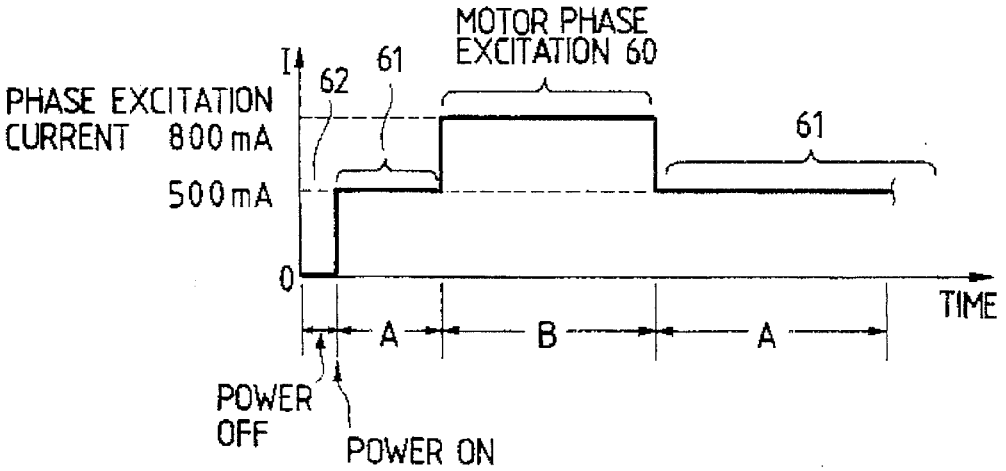
FIG. 6 is a chart showing an example of energization of motor phases.

FIG. 6 is a chart showing the phase energizing current I for the motor 25 as a function of time, wherein 60 indicates a state with elevated holding torque with an increased energizing current I, and 61 indicates a state with reduced holding torque with a decreased energizing current.

Further referring to FIG. 6, a period 62 indicates a state in which the power supply of the apparatus is turned off. In this state the phase energizing current I for the motor 25 is zero. When the power supply of the apparatus is turned on, the motor 25 is given a phase energizing current I for example of 500 mA in the present embodiment. In this state $A_0$ (period 61), either the ink sheet 14 is transported, or the ink sheet 14 and the recording sheet 11 are both stopped. In case of a white line, lacking the recording data over the entire line, the motor 25 is given a phase energizing current I for example of 800 mA (holding $B_0$: period 60), whereby the ink sheet 14 is not drawn by the movement of the recording sheet 11.

The heating in the thermal transfer printer is not limited to the above-explained method employing a thermal head, but can also be achieved for example by directly applying a current to the ink sheet or by heating it with a laser beam.

Also, though the foregoing embodiment has been limited to a thermal line head, there may be employed a so-called serial thermal transfer printer.

Furthermore, though the foregoing embodiment has been limited to a facsimile apparatus, the thermal transfer recording apparatus of the present invention is likewise applicable to a word processor, a typewriter, a copying apparatus or the like.

Also the recording medium is not limited to a recording paper, but can be a textile or a plastic sheet as long as ink transfer is possible. Also the ink sheet need not necessarily be a rolled structure shown in the foregoing embodiment, but can be constructed as a so-called ink sheet cassette detachably loaded in the recording apparatus.

As explained in the foregoing, the embodiment offers the benefit, in the transportation of the recording sheet or the ink sheet alone, of preventing the the other sheet from being drawn along by increasing the energizing current of a transporting motor for the the other sheet, thereby increasing the holding torque of the motor.

This advantage is particularly marked in a recording apparatus which has to conduct interrupting operation frequently for the line lacking the recording data, such as a facsimile apparatus.

As explained in the foregoing, the present invention provides an advantage, in the transportation of the recording medium or the ink sheet alone, of preventing the dragged movement of the other, by increasing the force for retaining the other in the stopped state.

What is claimed is:

1. A thermal transfer recording apparatus for recording an image on a recording medium by transferring an ink of an ink sheet onto said recording medium, comprising:

ink sheet conveying means having a first drive motor for conveying said ink sheet in a first direction;

recording medium conveying means having a second drive motor for conveying said recording medium in a second direction opposed to said first direction; and controlling means for controlling said second drive motor to generate a predetermined recording medium holding torque to prohibit movement of said recording medium in said first direction when said ink sheet conveying means conveys said ink sheet in said first direction and for controlling said first drive motor to generate a predetermined ink sheet holding torque to prohibit movement of said ink sheet in said second direction when said recording medium conveying means conveys said recording medium in said second direction, wherein said predetermined ink sheet holding torque is greater than a torque generated by said first drive motor to convey said ink sheet during a recording operation.

2. An apparatus according to claim 1, wherein said controlling means increases an energizing current for either one of said first drive motor and said second drive motor corresponding to whichever of said ink sheet and said recording medium which is not moved.

3. An apparatus according to claim 1, wherein said apparatus is a facsimile apparatus having a receiving mechanism for receiving an image information through an external communication line.

4. A sheet conveying method for a recording apparatus comprising ink sheet conveying means having a first drive motor for conveying an ink sheet in a first direction and recording sheet conveying means having a second drive motor for conveying a recording sheet in a second direction opposed to said first direction so as to record an image on said recording sheet using ink contained in said ink sheet, said method comprising the steps of:

conveying said ink sheet so that said second drive motor generates a predetermined recording sheet holding torque to prohibit movement of said recording sheet in said first direction when said ink sheet conveying means conveys said ink sheet in said first direction; and conveying said recording sheet so that said first drive motor generates a predetermined ink sheet holding torque to prohibit movement of said ink sheet in said second direction when said recording sheet conveying means conveys said recording sheet in said second direction, wherein said predetermined ink sheet holding torque is greater than a torque generated by said first drive motor to convey said ink sheet during a recording operation.

5. A method according to claim 4, further comprising the step of increasing an energizing current for either one of said first drive motor and said second drive motor corresponding to whichever of said ink sheet and said recording sheet which is not to be moved.

6. A method according to claim 4, wherein said recording apparatus is a facsimile apparatus having a receiving mechanism for receiving an image information through an external communication line.

7. A thermal transfer recording apparatus for recording an image on a recording medium by transferring an ink of an ink sheet onto said recording medium, comprising:

ink sheet conveying means having a first drive motor for conveying said ink sheet in a first direction;

recording medium conveying means having a second drive motor for conveying said recording medium in a second direction opposed to said first direction; and controlling means for controlling said second drive motor to generate a predetermined torque to prohibit movement of said recording medium in said first direction when said ink sheet conveying means conveys said ink sheet in said first direction, wherein said predetermined torque is greater than a torque generated by said second drive motor to convey said recording medium during a recording operation.

8. An apparatus according to claim 7, wherein said controlling means increases an energizing current for said second drive motor.

9. An apparatus according to claim 7, wherein said apparatus is a facsimile apparatus having a receiving mechanism for receiving an image information through an external communication line.

10. A thermal transfer recording apparatus for recording an image on a recording medium by transferring an ink of an ink sheet onto said recording medium, comprising:

ink sheet conveying means having a first drive motor for conveying said ink sheet in a first direction;

recording medium conveying means having a second drive motor for conveying said recording medium in a second direction opposed to said first direction; and controlling means for controlling said first drive motor to generate a predetermined torque to prohibit movement of said ink sheet in said second direction when said recording medium conveying means conveys said recording medium in said second direction, wherein said .predetermined torque is greater than a torque generated by said first drive motor to convey said ink sheet during a recording operation.

11. An apparatus according to claim 10, wherein said controlling means increases an energizing current for said first drive motor.

12. An apparatus according to claim 10, wherein said apparatus is a facsimile apparatus having a receiving mechanism for receiving an image information through an external communication line.

13. A sheet conveying method for a recording apparatus comprising ink sheet conveying means having a first drive motor for conveying an ink sheet in a first direction and recording sheet conveying means having a second drive motor for conveying a recording sheet in a second direction opposed to said first direction so as to record an image on said recording sheet using ink contained in said ink sheet, said method comprising the step of:

conveying said ink sheet so that said second drive motor generates a predetermined torque to prohibit movement of said recording sheet in said first direction when said ink sheet conveying means conveys said ink sheet in said first direction, wherein said predetermined torque is greater than a torque generated by said second drive motor to convey said recording sheet during a recording operation.

14. A method according to claim 13, further comprising the step of increasing an energizing current for said second drive motor.

15. A method according to claim 13, wherein said recording apparatus is a facsimile apparatus having a receiving mechanism for receiving an image information through an external communication line.

16. A sheet conveying method for a recording apparatus comprising ink sheet conveying means having a first drive motor for conveying an ink sheet in a first direction and recording sheet conveying means having a second drive motor for conveying a recording sheet in a second direction opposed to said first direction so as to record an image on said recording sheet using ink contained in said ink sheet, said method comprising the step of:

conveying said recording sheet so that said first drive motor generates a predetermined torque to prohibit movement of said ink sheet in said second direction when said recording sheet conveying means conveys said recording sheet in said second direction, wherein said predetermined torque is greater than a torque generated by said first drive motor to convey said ink sheet during a recording operation.

17. A method according to claim 16, further comprising the step of increasing an energizing current for said first drive motor.

18. A method according to claim 16, wherein said recording apparatus is a facsimile apparatus having a receiving mechanism for receiving an image information through an external communication line.

* * * * *

UNITED STATES PATENT AND TRADEMARK OFFICE

CERTIFICATE OF CORRECTION

PATENT NO. : 5,539,439

DATED : July 23, 1996

INVENTOR(S) : TAKESHI ONO ET AL.

It is certified that error appears in the above-identified patent and that said Letters Patent is hereby corrected as shown below:

Title page, item
[56] REFERENCES CITED

Foreign Patent Documents, "2095177" should read --59-95177--.

[57] ABSTRACT

Line 4, "sheet," should read --sheet-- and "therewith" should read --therewith,--.

COLUMN 1

Line 20, "to" should be deleted.
Line 33, "in" should read --kept in--.
Line 34, "kept" should be deleted.
Line 41, "skipping" should read --producing--.
Line 42, "transportation" should read --unwanted transportation-- and "ink" should read --the ink--.
Line 51, "Also" should read --Also,--.
Line 64, "an" should read --a--.

COLUMN 2

Line 3, "maintaining" should read --maintaining the the ink sheet--.
Line 4, "the ink sheet" should be deleted.
Line 18, "transportation of" should read --transporting--.
Line 19, "preventing" should read --retaining force for preventing--.
Line 20, "force for retaining" should be deleted.

UNITED STATES PATENT AND TRADEMARK OFFICE

CERTIFICATE OF CORRECTION

PATENT NO. : 5,539,439

DATED : July 23, 1996

INVENTOR(S) : TAKESHI ONO ET AL.

It is certified that error appears in the above-identified patent and that said Letters Patent is hereby corrected as shown below:

COLUMN 3

Line 29, "components" should read --same components--.
Line 30, "numbers." should read --same numbers.--.
Line 40, "being" should be deleted.

COLUMN 4

Line 42, "represented" should read --represented by--.
Line 59, "or type" should be deleted.
Line 62, "(characteristics)" should read --(characteristics or type)--.

COLUMN 5

Line 61, "dragged" should read --drawn--.
Line 62, "step S 12" should read --step S12--.

COLUMN 6

Line 9, "S 17" should read --S17--.
Line 24, "dragging" should read --drawing--.
Line 33, "dragging" should read --drawing--.
Line 57, "a" should be deleted.

COLUMN 7

Line 8, "the the" should read --the--.
Line 10, "the the" should read --the--.
Line 13, "interrupting" should read --interrupted--.

UNITED STATES PATENT AND TRADEMARK OFFICE

CERTIFICATE OF CORRECTION

PATENT NO. : 5,539,439

DATED : July 23, 1996

INVENTOR(S) : TAKESHI ONO ET AL.

It is certified that error appears in the above-identified patent and that said Letters Patent is hereby corrected as shown below:

COLUMN 7 (continued)

Line 18, "dragged" should read --drawn--.
Line 47, "which" should be deleted.

COLUMN 8

Line 11, "which" should be deleted.

Signed and Sealed this

Eleventh Day of February, 1997

Bruce Lehman

*Attest:*

BRUCE LEHMAN

*Attesting Officer*

*Commissioner of Patents and Trademarks*